US011152733B2

(12) United States Patent
Tristani et al.

(10) Patent No.: US 11,152,733 B2
(45) Date of Patent: Oct. 19, 2021

(54) FLAT ELECTRICAL CONNECTOR FOR SUPPLEMENTAL RESTRAINT SYSTEM

(71) Applicant: APTIV TECHNOLOGIES LIMITED, St. Michael (BB)

(72) Inventors: Laurent Tristani, Margon (FR); Partheeban Loganathan, Tamilnadu (IN)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/755,901

(22) PCT Filed: Oct. 22, 2018

(86) PCT No.: PCT/EP2018/078933
§ 371 (c)(1),
(2) Date: Apr. 14, 2020

(87) PCT Pub. No.: WO2019/081445
PCT Pub. Date: May 2, 2019

(65) Prior Publication Data

US 2020/0259287 A1 Aug. 13, 2020

(30) Foreign Application Priority Data

Oct. 23, 2017 (EP) ..... 17197693

(51) Int. Cl.
*A24F 13/00* (2006.01)
*H01R 13/424* (2006.01)
(Continued)

(52) U.S. Cl.
CPC ..... *H01R 13/424* (2013.01); *H01R 13/111* (2013.01); *H01R 13/631* (2013.01); *H01R 2201/26* (2013.01)

(58) Field of Classification Search
CPC .... H01R 13/424; H01R 13/111; H01R 13/631
(Continued)

(56) References Cited

U.S. PATENT DOCUMENTS 1,579,008 A * 3/1926 Lake, Jr. ..... H01R 4/10 439/860
3,016,512 A * 1/1962 Borchard ..... H01R 25/00 439/225
(Continued)

FOREIGN PATENT DOCUMENTS

CN 1153408 7/1997
CN 101926056 12/2010
(Continued)

OTHER PUBLICATIONS

International Search Report and Written Opinion for International application No. PCT/EP2018/078933 dated Jan. 15, 2019.

*Primary Examiner* — Phuong K Dinh
(74) *Attorney, Agent, or Firm* — Carlson, Gaskey & Olds, P.C.

(57) ABSTRACT

The invention relates to an electrical connector (1), adapted to be mated with a corresponding counter connector (3) in a mating direction (100). The electrical connector (1) comprises at least one female contact terminal (10) extending at least partially perpendicular to the mating direction (100) in an extension direction (200). The female contact terminal (10) comprises a distal portion (12) with two flexible spring arms (14) extending in extension direction (200). An engagement portion (16) is formed between the flexible spring arms (14) and is adapted to engage a corresponding male terminal (50) of the counter connector (3). The electrical connector (1) further comprises a connector housing (30) comprising at least one terminal cavity (32), adapted to house the female contact terminal (10). The terminal cavity (32) is adapted to essentially prevent movement of the
(Continued)

female contact terminal (10) parallel to both, the mating direction (100) and the extension direction (200).

20 Claims, 5 Drawing Sheets

(51) Int. Cl.
*H01R 13/11* (2006.01)
*H01R 13/631* (2006.01)

(58) Field of Classification Search
USPC ..... 439/374, 188, 352
See application file for complete search history.

(56) References Cited

U.S. PATENT DOCUMENTS 3,895,635 A * 7/1975 Justus ..... A61B 5/0424 606/32
4,775,337 A * 10/1988 Van Wagener ..... H01R 11/12 439/883
5,108,318 A 4/1992 Sakurai et al.
6,520,812 B1 * 2/2003 Machado ..... H01R 11/282 439/855
6,527,571 B2 * 3/2003 Muta ..... H01R 4/4809 439/246
6,743,051 B2 * 6/2004 Hayashi ..... H01R 13/719 439/352
2004/0166715 A1 8/2004 Parrish et al.

FOREIGN PATENT DOCUMENTS

CN 103594884 2/2014
DE 29 40 392 A1 9/1980
DE 10 2007 063592 A1 7/2009
FR 2936657 4/2010

* cited by examiner

FLAT ELECTRICAL CONNECTOR FOR SUPPLEMENTAL RESTRAINT SYSTEM

1. FIELD OF THE INVENTION

The present application relates to an electrical connector comprising a flat female contact terminal.

2. TECHNICAL BACKGROUND

Electrical connector systems are used for joining electrical circuits, wherein typically a male contact terminal is mated with a female contact terminal. In many occasions space for locating the electrical connectors is limited, such as for instance in cars, where multiple electrically driven Supplemental Restraint Systems (SRS) are needed to ensure an optimal interplay of safety components (e.g. between the airbag and the pretensioner of the safety belt) in an event of an accident.

The US patent application US 2004/0166715 A1 describes a typical squib connector arrangement as it is used in airbag systems. The arrangement comprises typically a socket assigned to the squib and a plug connector. The socket comprises two male terminals, namely pins, which come in electrical contact with the female contact terminals of the plug connector, when the same is plugged into the socket. As can be seen from FIG. 3 in U.S. '715, cavities are provided in the housing of the connector extending in mating direction to house corresponding female terminals, which have the task to establish a connection with the male terminals (pins). These female terminals are usually produced from an "endless" plain strand of conductive material, e.g. metal. During terminal production, the strand is pierced and bent, usually in a rectangular manner, to its final shape, as it is shown in FIG. 11 of U.S. '715, and finally cut into smaller pieces to achieve the desired single terminal units. The terminals are usually bend in a way, that they comprise an upper portion having a cylindrical shape with a circular cross section and a lower portion provided with springs, extending parallel to the mating direction, which are able to grab the male terminals and thus establish an electrical connection. The design of such connectors is highly dependent on the place of installation. In cars, said connectors are widely used in SRSs, like for example in airbag systems. Especially the installation of the electrical parts in certain armatures, for example in the steering wheel, is highly space constrained, so all parts have to be designed as less space consuming as possible.

Thus, it is the objective of the present invention to provide an electrical connector with a compact and space saving design, while maintaining its reliability of functionality.

3. SUMMARY OF THE INVENTION

The present invention relates to an electrical connector, adapted to be mated with a corresponding counter connector in a mating direction, the electrical connector comprising at least one female contact terminal extending at least partially perpendicular to the mating direction in an extension direction, wherein the female contact terminal comprises a distal portion with two flexible spring arms extending in extension direction, and wherein an engagement portion is formed between the flexible spring arms, and which is adapted to engage a corresponding male terminal of the counter connector, and a connector housing comprising at least one terminal cavity, adapted to house the female contact terminal. The female contact terminal is cut from a piece of sheet metal and the two spring arms are unbent and arranged in a common plane perpendicular to the mating direction.

This construction of the contact terminal allows a very simple manufacturing of the terminal, since the heretofore necessary bending steps can be omitted. At the same time, the terminal has a very flat design and allows the construction of connector housings having a correspondingly low profile or flat design. Such a design is very advantageous in applications where space is limited, as it is typically the case with restraint system (SRS). Both spring arms are arranged in the same plane, which is preferably the plane of extension of the sheet metal the terminal is cut from.

Thus, the female contact terminal according to the present invention may accordingly not be bent in an angular manner, such in a rectangular manner, and thus essentially extends along its extension direction, which allows for a reduced total height of the connector in mating direction, which may be less than 10 mm, preferably less than 9 mm, more preferably less than 8 mm, for example about 7.5 mm. Accordingly, the female contact terminal according to the present invention may comprise a height of less than 5 mm preferably less than 4 mm and more preferably less than 3 mm.

To provide a homogeneous force application of the flexible spring arms towards the male terminal, the flexible spring arms may be provided symmetrically, such that each arm comprises the same length along the extension direction of the female contact terminal, the same height along the mating direction and the same width along a direction perpendicular to both, the extension direction of the female contact terminal and the mating direction, and may be arranged in a symmetrical manner with respect to the male terminal. The two flexible spring arms may be provided such that they can flexibly bend essentially perpendicular to both, the extension direction of the female contact terminal and the mating direction. The spring arms can flexibly bend away from a resting position and are thus biased when a male terminal is inserted. The arms can comprise a width of from 0.1 mm to 1 mm, preferably of 0.2 to 0.8 mm and more preferably of from 0.4 to 0.6 mm. Biasing of the spring arms leads to a proper mechanical and electrical connection between the female contact terminal and the corresponding male contact terminal at the engagement portion. However, during insertion (plugging) of the male terminal, a force parallel to the mating direction is applied to the flexible spring arms, which may induce an undesired movement of the spring arms or the whole female contact terminal parallel to the mating direction. A proper dimensioning of the terminal cavity of the connector housing can prevent such a disadvantageous movement by blocking any unwanted movements parallel to the mating direction and thus can facilitate providing a defined grabbing and holding of the male terminal at the engagement portion of the spring arms. Thus, a pre-defined force can be applied essentially perpendicular to the mating direction from the flexible spring arms to the male terminal.

As noted above, the female contact terminal, including the flexible spring arms, essentially extends in said extension direction. Thus, no angular bending of the female contact terminal during the manufacturing process needs to be applied, which allows for a particular flat design of the female contact terminal. That is, the female contact terminal comprises a low height along mating direction, which can essentially be equal the thickness of a metal strand from which the female contact terminal is produced. The spring arms can be produced from any suitable electrically conducting material, for instance a metal such as copper. The thickness of the metal strand can be for instance 0.4 mm. Accordingly, the height of the whole electrical connector along mating direction can be advantageously reduced. Another benefit is that the manufacturing process is simplified such that the terminal can be produced at higher speeds, such as for instance 6,000 parts per minute since essentially no bending of the spring arms is necessary to produce the female contact terminal according to the present invention.

The electrical housing can be made of any suitable electrically insulating material, such as for instance plastic, and can be manufactured for example by a casting or molding process as an integral part or it can be assembled by multiple parts, as long as a proper protection of any electrically conducting parts, which are housed inside the housing, from unfavorable environmental influences such as moisture, dust and/or mechanical impacts etc., is provided. Further, the housing should essentially be formed such that the female contact terminal is located in a defined mating position when it is correctly arranged in the terminal cavity. Accordingly, the female contact terminal, and particularly the engagement portion, should be provided at a pre-defined position along the mating direction, as well as at a pre-defined position in a plane perpendicular to the mating direction, to ensure a proper mating with the male terminal.

Preferably, the two springs arms are flat and each having an oblong rectangular cross section (as seen in extension direction), and whereby the spring arms are oriented in the cavity such that the longer perimeter of the rectangle is in a plane perpendicular to the mating direction. An oblong rectangle is a non-square rectangle, where one perimeter (or side) is larger than the other, i.e. where the length "l" is larger than the width "w". Thus, the flat spring arms are oriented such that their smallest extension (i.e. their width) is in the mating direction. This again helps to ensure a very compact design of the connector.

Preferably, the terminal cavity is shaped to essentially prevent movement of the female contact terminal parallel to the mating direction and also preferably in the extension direction. This ensures a correct alignment of the terminal and thus a safe and reliable mating process with the counter connector.

In a preferred embodiment, the engagement portion is formed at a distal end portion of the flexible spring arms. The female contact terminal can comprise a tuning-fork like shape. Thus, a maximum degree of flexibility of the spring arms during the mating procedure can be provided when the male terminal engages at a distal side of the spring arms.

In another preferred embodiment, inner walls of the engagement portion are arcuate such that they form a cylinder extending in mating direction, preferably wherein the radius of the arcuate inner walls is about twice the radius of the male terminal, perpendicular to the mating direction. Accordingly, the inner walls of the engagement portion can contact a corresponding male terminal at a larger contact surface, if for instance a pin is used as a male terminal, which comprises a corresponding arcuate outer surface. As will be understood, the cylinder may or may not comprise a circular cross-sectional area, perpendicular to the mating direction. For instance, the cross-sectional area of the cylinder may also be essentially elliptic. Further, the arcuate inner walls may or may not contact each other. Thus, a gap may remain between the arcuate inner walls in a non-mated and/or in a fully mated condition. Thus, a homogenous force transmission and also a proper electrical current transmission can be provided. The radius of the cylinder, formed by the inner walls, into which the male terminal is to be inserted, should be dimensioned such that the male terminal does not bend the flexible spring arms above their elastic limit upon insertion, which can lead to a non-reversible deformation of the flexible spring arms. Accordingly, the arcuate inner walls of the engagement portion of the flexible spring arms may comprise a radius that is about twice the radius of a cross-sectional area perpendicular to the mating direction of a male terminal to be inserted. This can provide a sufficiently large aperture and reduces a bending of the spring arms by a male terminal, such that the elastic limit of the spring arms would not be reached. Thus, any damages of the spring arms can be prevented. For example, when a distance between the arcuate inner walls of the two flexible spring arms which comprise a sufficiently large radius at the engagement portion is chosen to be 0.8 mm before insertion of the male terminal, and the elastic limit of the flexible spring arms would be reached at a distance of 1.2 mm, said critical distance would not be reached by an insertion of a male terminal comprising a diameter of 1 mm, so that any undesired non-elastic deformations of the spring arms would be prevented. In another preferred embodiment, the radius of the arcuate inner walls is from 0.1 mm to 10 mm, preferably from 0.2 mm to 5 mm and most preferably from 0.5 to 2 mm, for example 0.8 mm.

In another preferred embodiment, the engagement portion of the flexible spring arms comprises inclined surfaces at a top and/or bottom side of the flexible spring arms along mating direction to provide a funnel above and/or below the engagement portion adapted to guide the male terminal towards the engagement portion. The inclined surfaces facilitates a guidance of the male terminal towards the engagement portion while it is moved parallel to the mating direction and thus can provide a smooth insertion at the engagement portion since the male contact terminal can essentially slide along the inclined surfaces along the funnel towards the final mating position. The inclined surfaces at the top and/or bottom side of the engagement portion can be for instance obtained by a coining step performed subsequent to the cutting step during the manufacturing of the female contact terminal. Further, burrs can be removed by the coining step at the top and bottom edges of the engagement portion, which further facilitates a smooth insertion.

In another preferred embodiment, the connector housing comprises a first guide member, adapted to guide the male terminal towards the engagement portion parallel to the mating direction, preferably wherein the first guide member tapers conically against mating direction. During the plugging, it is important that the male terminal is properly guided to a pre-defined position at which the female contact terminal engages the male terminal. Accordingly, the first guide member provides a first alignment of the male terminal along the mating direction before the male terminal engages the female contact terminal. Advantageously, the first guide member is an integral part of the connector housing such that any forces potentially occurring due to an initial misalignment of the male terminal are accordingly applied mainly to the connector housing. Thus, a housed female contact terminal can be protected from any damages caused by said forces. A conical shape of the first guide member allows for a proper guidance of a male terminal in a manner that larger deviations of the position of the male contact terminal at the beginning of the plugging process can be corrected while the male terminal is guided along the inner walls of the conus towards the narrow end. Thus, the first guide member can guide the male terminal towards the extension axis of the conus and accordingly an exact pre-defined position in a plane perpendicular to the mating direction can be provided.

In another preferred embodiment, a second guide member is arranged adjacent above the first guide member, as seen against mating direction, wherein said second guide member is a square-shaped hole extending parallel to the mating direction, preferably comprising a side length equal to the diameter of the male terminal. Providing a second guide member above the first guide member, which is a square-shape hole, can provide further guidance of the male terminal during the plugging process. In particular, when the side lengths of the square-shaped hole equal the diameter of a male terminal, which can be for instance a pin, the square-shaped hole contacts the pin only at small portions located essentially at the central points of each side length. Thus, a reduced friction between the pin and the connector housing can be obtained. Since the pin can only enter the square-shaped hole when it is exactly aligned coaxially to the mating direction in the square-shaped hole, rubbing of the connector housing at the contact portions can be minimized, whereas a proper positioning of the male terminal can be maintained. The square-shaped hole can be arranged below the contact portion of the flexible spring arms such that a pin, which is inserted from the bottom side, is initially aligned by the conical first guide member and then subsequently aligned by the square-shaped hole before it enters the engagement portion of the flexible spring arms in a at well-defined manner. However, of course also other shapes and arrangements of the guidance members may be used, as long as a proper guidance of the male contact terminal towards the engagement portion can be provided.

In another preferred embodiment, the terminal cavity comprises a roof member, arranged above the female contact terminal as seen in mating direction and blocking movement of the female contact terminal in mating direction. The roof member can be arranged above the female contact terminal in a manner that any undesired bending of the flexible spring arms parallel to the mating direction is prevented, by e.g. being in contact with the upper side of the arms. This improves the reliability of the electrical connection and further prevents damages of the flexible spring arms. Further, the whole female contact terminal can be housed in a manner that only a particular degree of freedom of movement parallel to the mating direction is allowed. This provides protection of the female contact terminal against vibrations or other environmental impacts. In another preferred embodiment, a maximum movement of the female contact terminal parallel to the mating direction is not more than 1 mm, preferably not more than 0.5 mm and more preferably not more than 0.1 mm. Accordingly, a well-defined narrow range of freedom of movement of the female contact terminal can be provided.

In another preferred embodiment, the roof member is integrally formed with the connector housing or is a separate part. An integral formation of the roof member with a connector housing improves robustness of the electrical connector since all parts of the connector housing, including the terminal cavity and the roof member, can be produced as one single part, for instance by a casting or molding process. The roof member can further comprise spacing means for defining a desired distance between the female connector and the roof member in a closed condition of the electrical connector.

In another preferred embodiment, the inner walls of the terminal cavity comprise at least one locator member and wherein the female contact terminal comprises at least one corresponding counteracting locator member which is adapted to engage the locator member such that the female contact terminal is positioned in the terminal cavity at a predefined position when the locator member engages the corresponding counteracting locator member. A proper positioning of the female contact terminal within the terminal cavity is essential to ensure that the male terminal engages the engagement portion of the flexible spring arms at a pre-defined location. In another preferred embodiment, the at least one locator member is a protrusion extending from the inner walls of the terminal cavity and wherein the counteracting locator member is a corresponding recess provided at a proximal portion of the female contact terminal, extending through the female contact terminal or vice versa. Said locator members, which can be for instance a protrusion of the connector housing and a corresponding recess of the female contact terminal, can be dimensioned such that a correct positioning of the female contact terminal can be provided, if the locator members correctly engage each other. Further, any undesired movement of the female contact terminal perpendicular to the mating direction can be prevented, once the locator members engage each other. The proximal portion of the female contact terminal can be adapted such that an electrical connection, e.g. with a wire, can be established at this portion, by for instance resistance welding or any other suitable means.

In another preferred embodiment, a spacer is provided in a gap, which extends between the flexible spring arms, wherein the spacer is preferably provided at the distal end portion of the flexible spring arms. In another preferred embodiment, said spacer protrudes from the inner wall of the terminal cavity; and wherein the spacer is adapted such that the female contact terminal is positioned in a predetermined mating position in the terminal cavity when the tips of the flexible spring arms engage the spacer. The engagement of the tips with the spacer can ensure that the tips of the flexible spring arms are correctly positioned at the distal portion within the terminal cavity. Said spacer can prevent any undesired closure of the flexible spring arms and thus can provide a pre-defined minimum size of the aperture of the engagement portion. The spacer can provide a proper alignment of the female contact terminal in the terminal cavity, together with the above noted locator members. Thus, it can be ensured that the female contact terminal is well positioned within the terminal cavity.

In another preferred embodiment, any locator members and/or spacer are integrally formed with the connector housing. An integral formation of the locator members and/or the spacer can provide an increased robustness against any mechanical impacts, such as vibrations, which are applied to the electrical connector. Further, manufacturing and assembly of the connector housing is simplified since no additional parts are required.

In another preferred embodiment, a contact force is provided between the engagement portion and the male terminal, when the electrical connector is fully mated with the counter connector, from 0.1 N to 10 N, preferably 0.5 N to 5 N and more preferably from 1 N to 2 N. A properly pre-defined contact pressure can be advantageous to provide a reliable electrical connection between the male and female contact terminals. As an example, a male terminal, such as for instance a pin, can comprise a diameter of 1 mm. Further, the radius of the arcuate inner walls of the engagement portion may be 1 mm and even further, each flexible arm of the female contact terminal may comprise a width of 0.4 mm. Accordingly, an optimum contact force may be about 1.5 N, which can be obtained by flexible spring arms comprising a length of 4 mm. The applied force should be sufficient to establish a reliable electrical connection but should not be too large, to still allow for a smooth insertion of the male terminal.

In another preferred embodiment, the electrical connector is a SRS connector. Such kind of connectors are currently used for instance in airbag systems of cars.

Preferably, the electrical connector further comprises a ferrite element having a cavity to at least partially accommodate the female contact terminal, wherein the cavity is shaped to match with the cross section of the terminal to minimize any gaps between the inner walls of the cavity and the surface of the terminal arranged therein. By minimizing the gaps, the shielding effectiveness of the ferrite is improved. In case that the part of the terminal accommodated by the ferrite has a rectangular cross section, also the cross section of the ferrite is rectangular and dimensioned such that the terminal fits snuggly in the cavity.

The present invention further relates to an electrical connector system, comprising the electrical connector as described above and in the enclosed claims, and a corresponding counter connector.

Preferably, the corresponding counter connector comprises a male terminal in form of a contact pin. The pin may comprise sizes, which are typical for electrical connector pins that are used in electrical connectors for instance in cars, and which may comprise a diameter of 0.2 to 3 mm, preferably of 0.3 to 2 mm, more preferably of 0.3 to 1 mm.

4. DESCRIPTION OF THE DRAWINGS

For a better understanding of the present invention and to appreciate its practical applications, the following figures are provided in reference hereafter. It should be noted that the figures are given as examples only and in no way limit the scope of the present invention.

FIG. 1 shows a top view of an electrical connector according to the present invention comprising a female contact terminal housed in a terminal cavity.

FIGS. 2*a* and 2*b* show a female contact terminal according to the present invention in a side view (FIG. 2*a*) and in a top view (FIG. 2*b*).

Figure 5A:
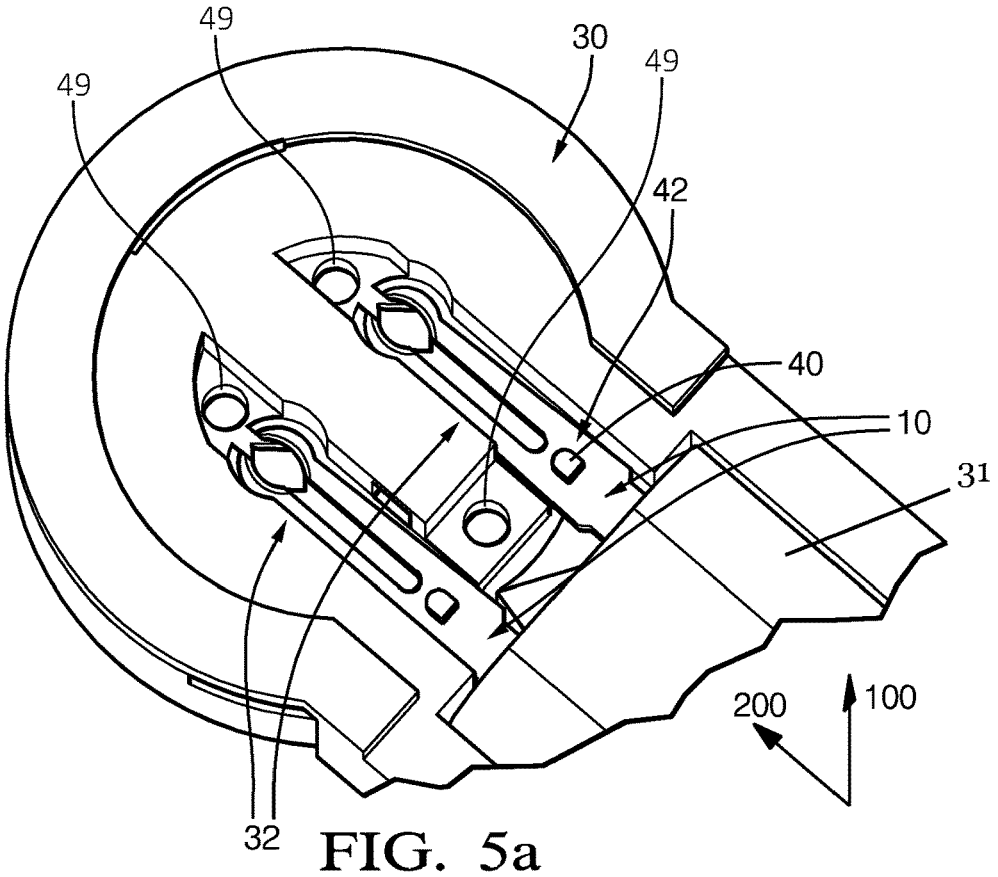
Figure 5B:
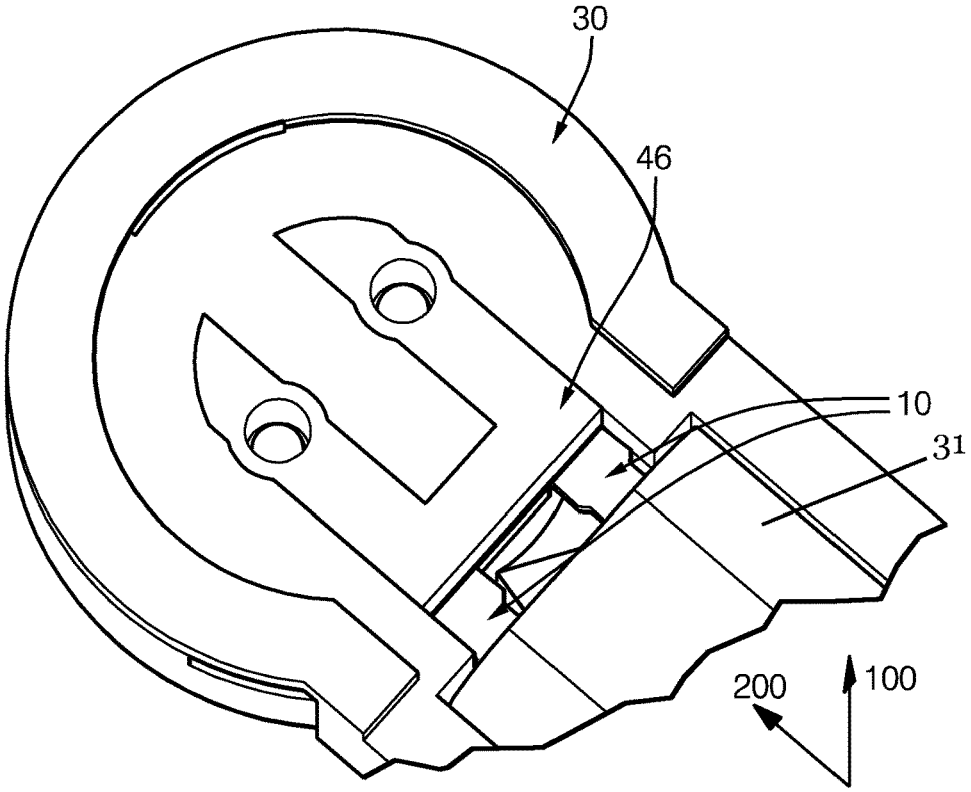

FIGS. 5*a* and 5*b* show a top view of an electrical connector according the present invention without a roof member (FIG. 5*a*) and with a roof member inserted in the terminal cavities (FIG. 5*b*).

Figure 6:
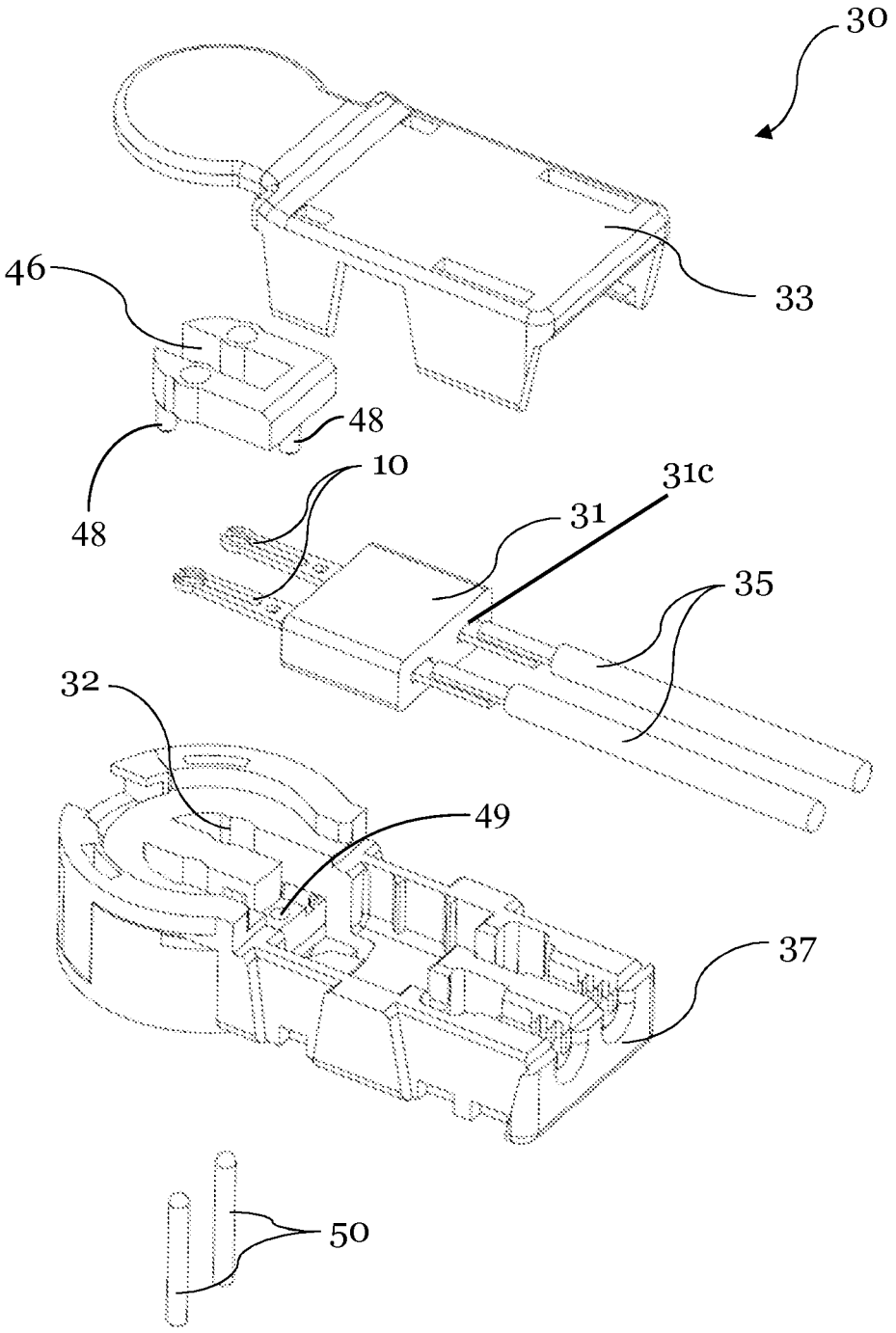

FIG. 6 shows a three-dimensional exploded view of the connector shown in FIGS. 5*a* and 5*b*.

Figure 7A:
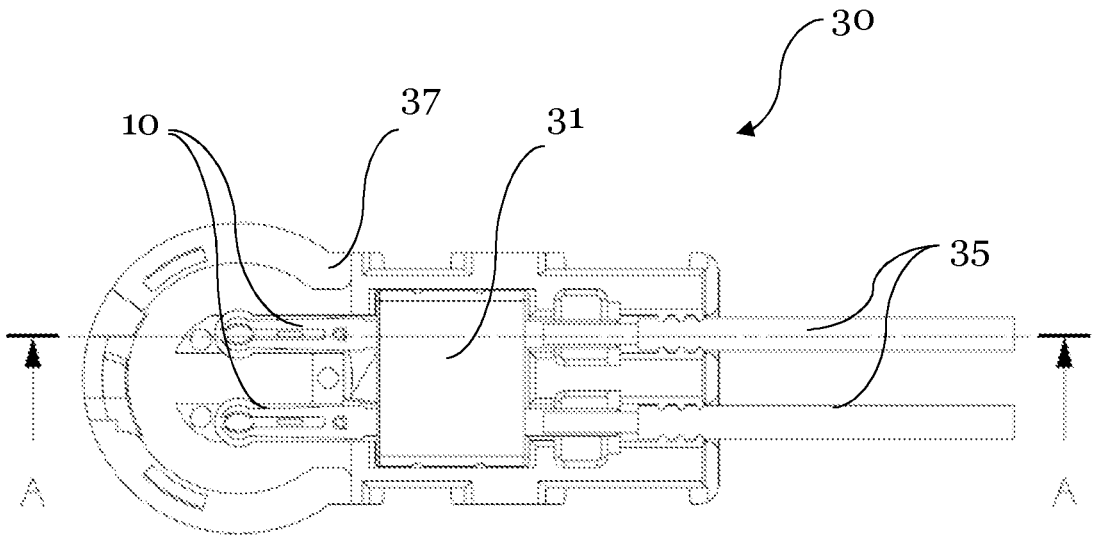

FIG. 7*a* shows a top view of the connector of FIG. 6 with the cover removed.

Figure 7B:
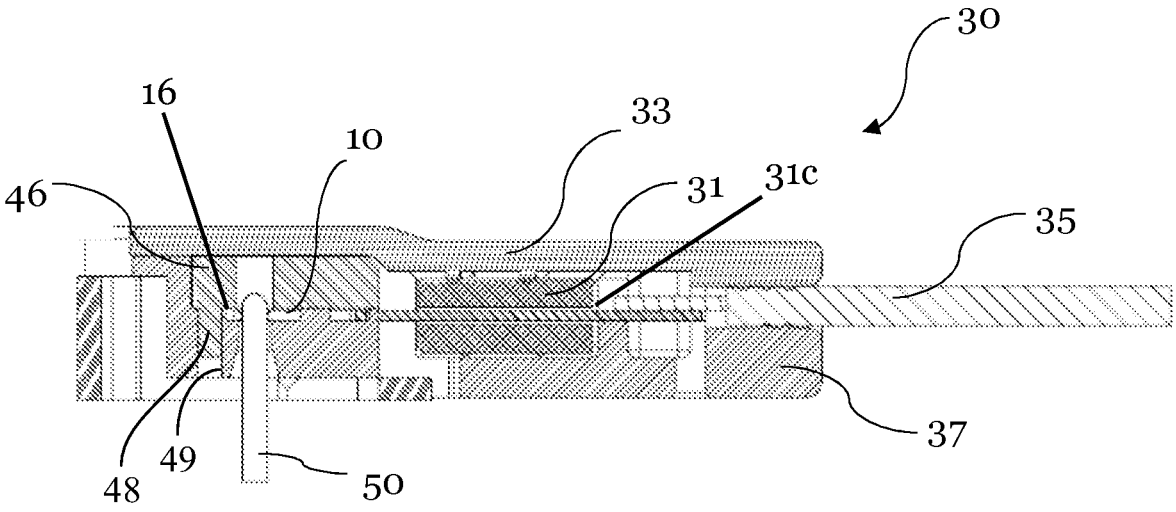

FIG. 7*b* shows a cut view of the connector of FIG. 7*a* along the lines A-A with the cover attached.

5. DESCRIPTION OF THE PREFERRED EMBODIMENTS

In the following, the present invention will now be described in more detail hereinafter with reference to the accompanying figures in which exemplary embodiments of the invention are illustrated. However, the present invention may be embodied in different forms and should not be construed as limited to the embodiments set forth herein. Rather, these examples are provided so that this disclosure will be thorough and will convey the scope of the invention to persons skilled in the art. Further, same reference signs identify similar parts of the following embodiments.

Figure 1:
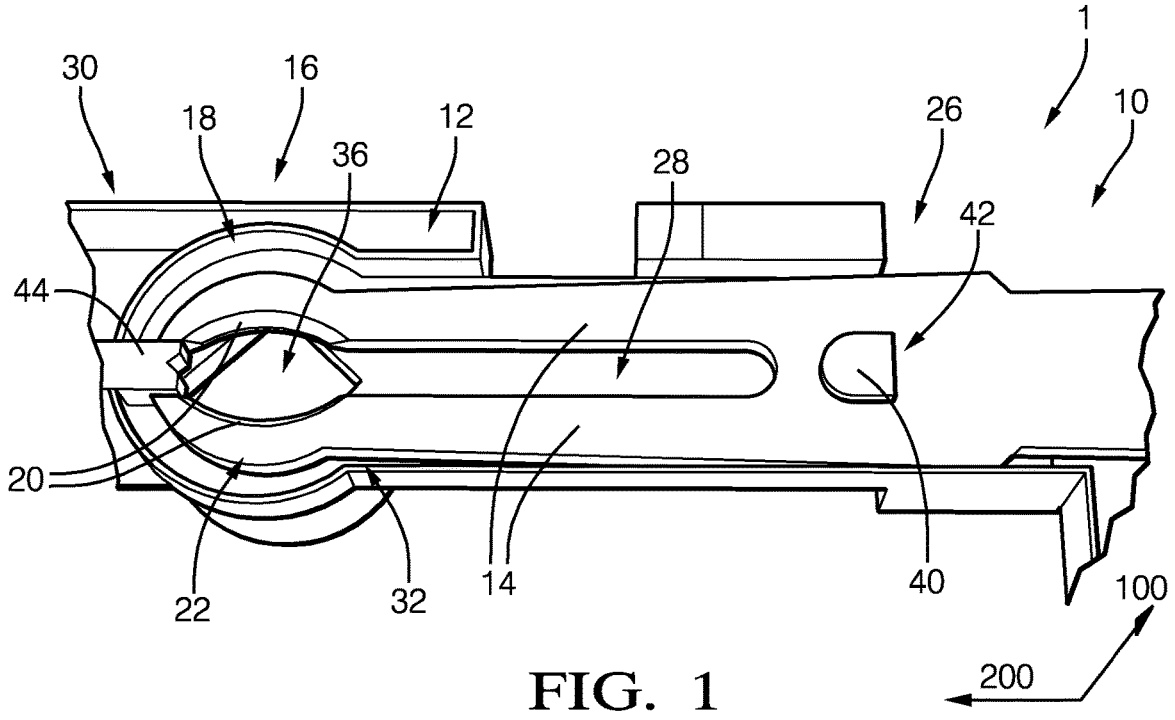

FIG. 1 shows a top view of an electrical connector 1 according to the present invention. The electrical connector 1 comprises female contact terminal 10 cut from a piece of sheet metal, wherein the female contact terminal 10 is housed in a terminal cavity 32 of the connector housing 30. Both, the terminal cavity 32 and the female contact terminal 10 extend essentially along a female contact terminal extension direction 200. The female contact terminal 10 comprises a proximal portion 26 and a distal portion 12, at which an engagement portion 16 is provided. The female contact terminal 10 comprises two flexible spring arms 14, which essentially extend in the female contact terminal extension direction 200. Between the flexible spring arms 14, a gap 28 is provided. The engagement portion 16 is provided at a distal end portion 18 of the flexible spring arms 14. The engagement portion 16 is formed such that an engagement of a corresponding male terminal 50, which extends parallel to a mating direction 100 can be provided. The engagement portion 16 of the flexible spring arms 14 is formed such that inner walls 20 of the engagement portion 16 are arcuate in a way that they form a cylinder 22 at the distal end portion 18 of the flexible spring arms 14. As depicted, the cross-sectional area of the cylinder 20 is essentially elliptic.

Further, the arcuate inner walls 20 do not contact each other. Thus, a gap is provided between the arcuate inner walls 20 in a non-mated condition. The inner walls 20 are adapted to engage an outer surface of the corresponding male terminal 50 when a connection is established between the electrical connector 1 and a corresponding counter connector 3 along mating direction 100. The tips of the flexible spring arms 14 are spaced apart by an optional spacer 44 which protrudes from the inner walls 38 of the terminal cavity 32. Further, a locator member 40 is provided in the terminal cavity 32, which protrudes from the inner walls 38 of the terminal cavity 32 and which engages a corresponding counter acting locator member 42, which is a correspondingly formed recess, provided in the proximal portion 26 of the female contact terminal 10.

Figure 2A:
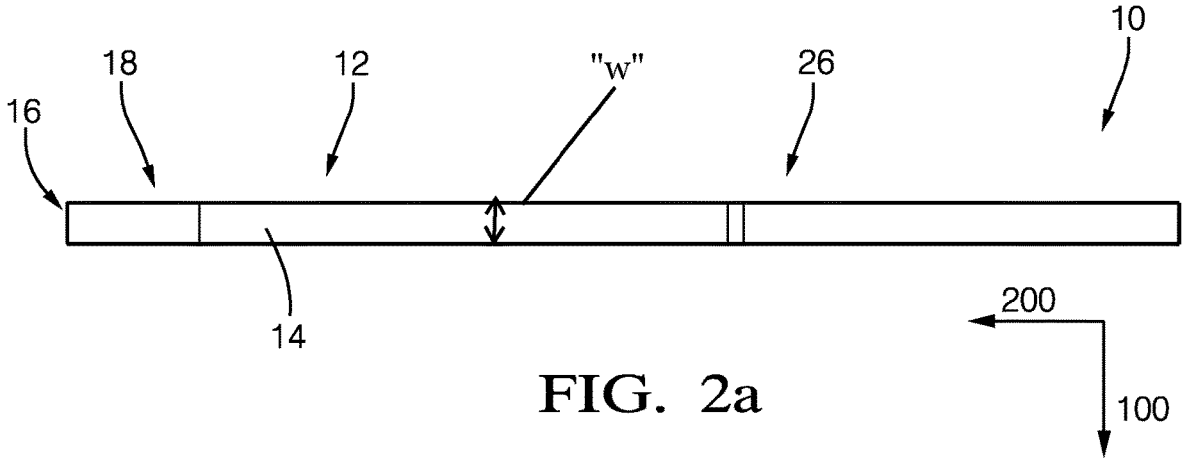

FIG. 2*a* shows a side view of the female contact terminal 10, wherein the female contact terminal 10 extends along the female contact terminal extension direction 200, perpendicular to the mating direction 100. The female contact terminal 10 comprises a proximal portion 26 and a distal portion 12, wherein the flexible spring arms 14 are provided at the distal portion 12. At the distal end portion 18 of the flexible spring arms 14 an arcuate engagement portion 16 is provided. The female contact terminal 10 essentially extends along the female contact terminal extension direction 200 and comprises a low height along mating direction 100.

Figure 2B:
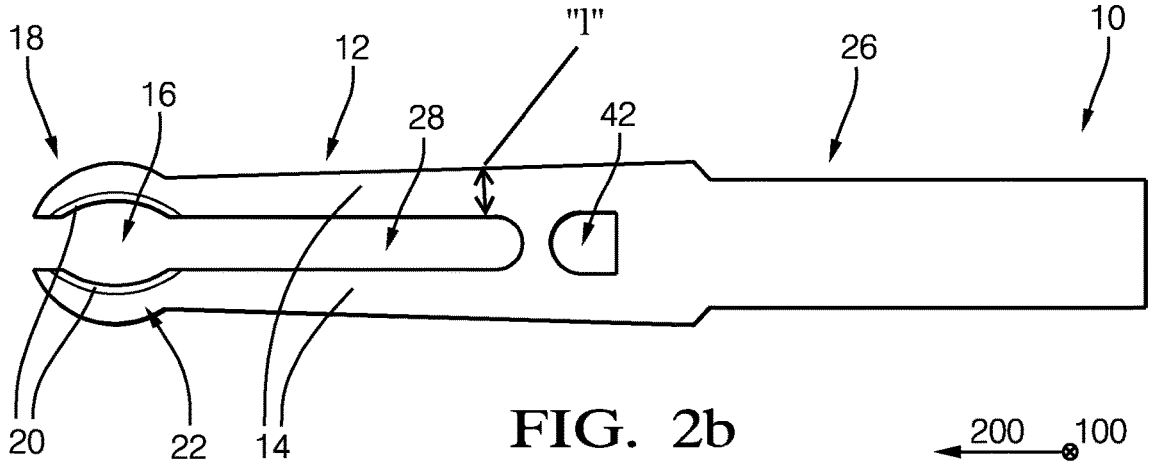

FIG. 2*b*, shows the female contact terminal 10 of FIG. 2*a* in top view. A gap 28 essentially extends in the female terminal extension direction 200 between the flexible spring arms 14. Further, the gap 28 extends through the female contact terminal 10 along the mating direction 100. Further, a counteracting locator member 42 in form of a recess is provided, which extends through the female contact terminal 10 along mating direction 100. At the distal end portion 18 of the flexible spring arm 14, the engagement portion 16 is provided in an arcuate manner such that a cylinder 22 is formed by the inner walls 20. The cross-sectional area of the cylinder 22 is essentially elliptic. Further, the arcuate inner walls 20 do not contact each such that a gap remains between the arcuate inner walls 20. The female contact terminal 10 is provided as an integrally formed part. The flexible spring arms 14 can flexibly bend essentially perpendicular to the mating direction 100 and the female terminal extension direction 200.

As one can take from FIGS. 2*a* and 2*b*, the female contact terminal 10 is cut from a piece of sheet metal and the two spring arms 14 are unbent and arranged in a common plane perpendicular to the mating direction. The two springs arms are flat and each having an oblong rectangular cross section (as seen in extension direction), i.e. one perimeter or length "l" of the cross section is larger than the other perimeter or width "w". The spring arms are oriented in the cavity such that the longer perimeter "l" of the rectangle is in a plane perpendicular to the mating direction 100, whereas the shorter perimeter "w" is parallel to the mating direction 100. The width "w" is the thickness of the piece of sheet metal the terminal is cut from, so that a very flat and compact design is achieved. The FIG. 2*a* is not true to scale, but the width "w" is enlarged in comparison to the length "l" for illustrative purposes. In practice, the width "w" will be typically less than 50% of the length "l", even at the narrowest parts of the spring arms. Preferably, the longer perimeter "l" of the spring arms is at the narrowest portion at least 100% larger than the short perimeter "w", more preferably 150% larger and most preferably at least 200% larger.

Figure 3:
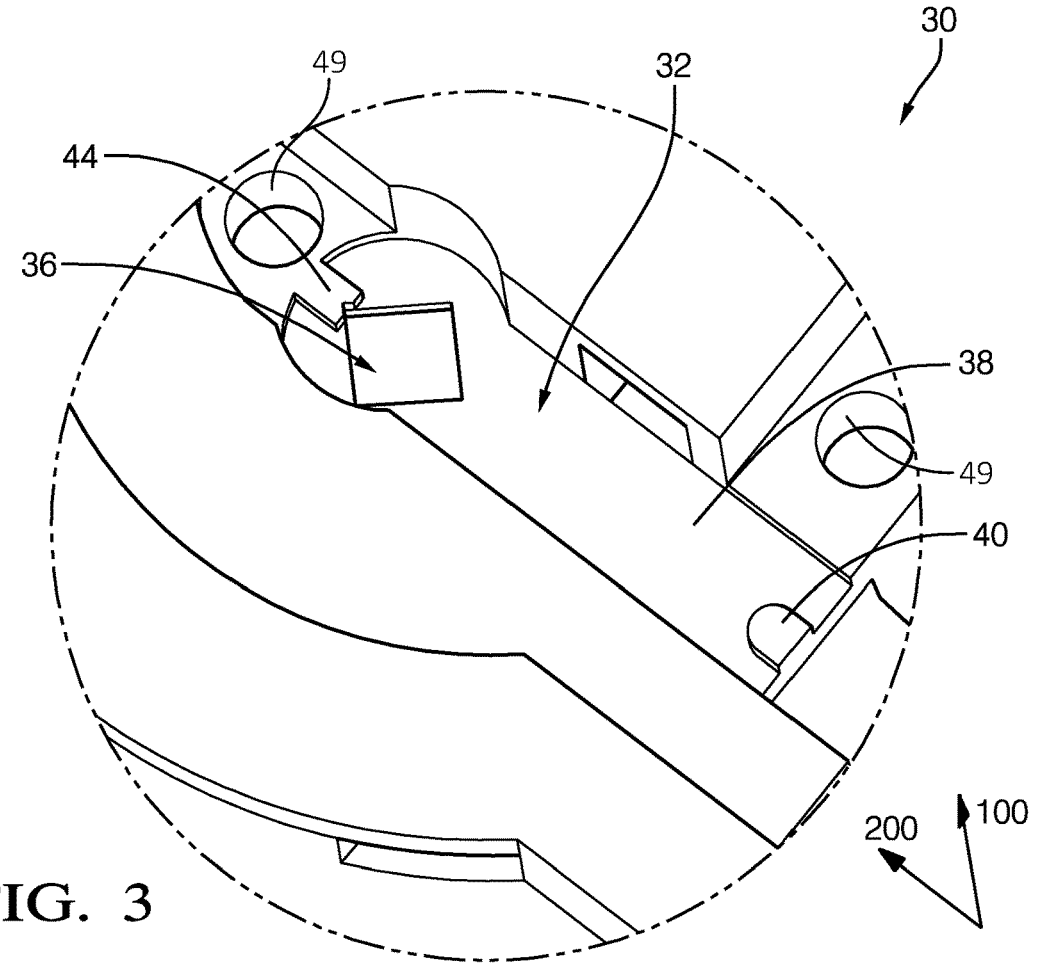
FIG. 3 shows a top view of a terminal cavity according to the present invention.

FIG. 3 shows a top view of a terminal cavity 32 of a connector housing 30 according to the present invention. The terminal cavity 32 comprises inner cavity walls 38 from which a locator member 40 protrudes. Further, a spacer 44 protrudes from the inner cavity walls 38. The terminal cavity 32 comprises a height, which extends parallel to the mating direction 100, and which is sufficient to house a corresponding female contact terminal 10. The terminal cavity 32 essentially extends along the female contact terminal extension direction 200.

The locator member 40 is provided at a proximal part of the terminal cavity 32 and further the spacer 44 is provided at a distal part of the terminal cavity 32. Further, a second guide member 36 is provided at the bottom side of the distal portion of the terminal cavity 32 in form of a square-shaped hole. The square-shaped portion is adapted to house a corresponding male terminal 50 which can be inserted from the bottom side along the mating direction 100. The square-shaped hole is dimensioned such that the side lengths of the square-shaped hole equal a diameter of a male terminal 50. As depicted, all parts of the connector housing 30 are integrally formed parts.

Figure 4:
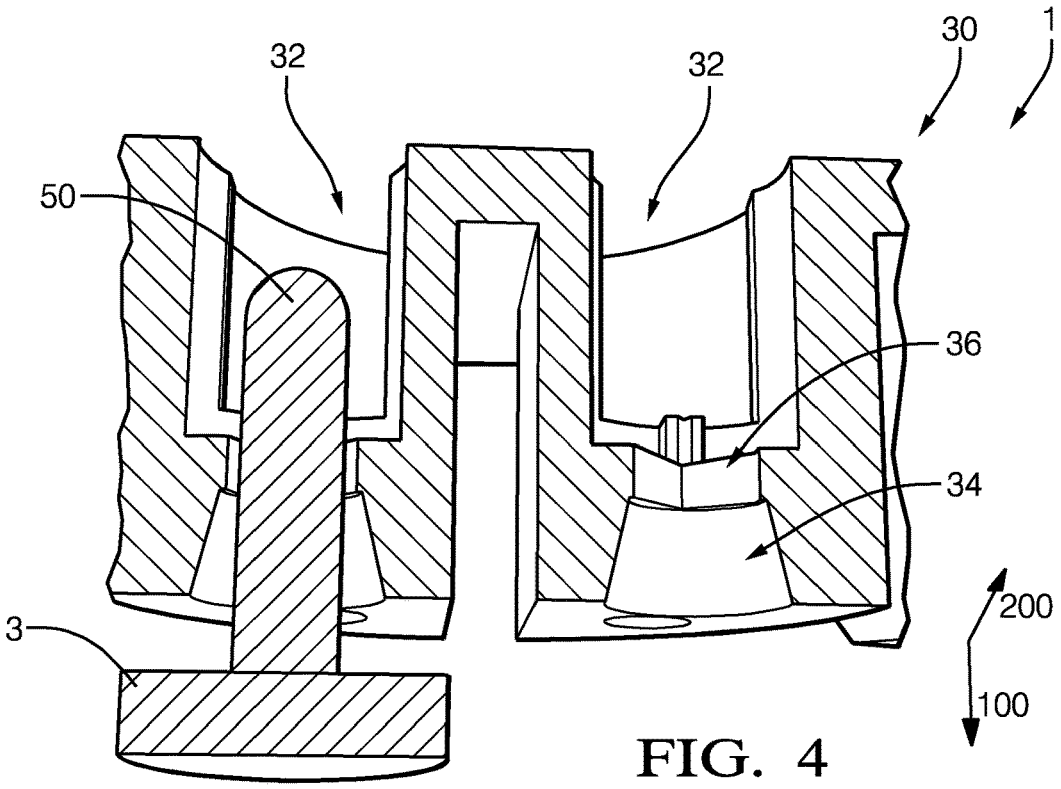
FIG. 4 shows a cross-sectional view of the terminal cavity according to the present invention with a male terminal inserted.

FIG. 4 shows a cross sectional view of a distal portion of a connector housing 30 of the electrical connector 1 which comprises two separated terminal cavities 32. As depicted, a corresponding counter connector 3 is located below the electrical connector 1 and a male terminal 50 in form of a pin is inserted from the bottom side along the mating direction 100 in the electrical connector 1. In the figure, the electrical connector housing 30 comprises two insertion portions at which the male terminal 50 could be inserted. At the left cavity, the pin 50 is shown in an inserted condition, whereas on the right cavity, no pin 50 is inserted. A first guide member 34 is depicted at the bottom side of the connector housing 30, which is adapted to guide the male terminal 50 along the mating direction 100. The male terminal 50 can be accordingly guided from the bottom side towards a second guide member 36, which is formed as a square-shaped hole. As shown at the left cavity, the pin 50 tightly fits into the square-shaped hole and thus a proper positioning of the pin 50 perpendicular to the mating direction 100 is obtained.

FIG. 5*a* shows a top view of an electrical connector 1 which comprises a connector housing 30 with two separated terminal cavities 32 extending essentially along a female contact terminal extension direction 200. The two terminal cavities 32 each house a female contact terminal 10 extending along the female contact terminal extension direction 200. The female contact terminals 10 shown in a correctly housed condition, since a locator member 40 in form of a protrusion is tightly fitted into a corresponding counteracting locator member 42 in form of a recess, provided at a proximal portion of the female contact terminal 26. Movement of the female contact terminals 10 along the terminal extension direction 200 is accordingly prevented, whereas the flexible arms 14 of the female contact terminals 10 can flexibly bend essentially perpendicular to the female contact terminal extension direction 200 and the mating direction 100. The female contact terminals 10 comprise a height along the mating direction 100 which is smaller than the height of the terminal cavity 32.

FIG. 5*b* shows the electrical connector 1 of FIG. 5*a* with a roof member 46 that is provided above the female contact terminals 10 and which is housed by the terminal cavities 32. The roof member 46 and the connector housing 30 (e.g., main body 37) together provide removably interlocking pins 48 and holes 49 to locate the roof member 46 relative to the connector housing 30 and capture the female contact terminal 10 there between. As depicted, the roof member 46 is provided as a separated part (i.e., is removably interlocked). The roof member 46 is formed in a U-shaped manner such that the two arms of the roof member 46 are housed by the terminal cavities 32 and are connected by a connection bar. The roof top member 46 is in contact with the upper surface of the terminals and fixes them in place, so that movement of the female contact terminals 10 parallel to the mating direction 100 is essentially prevented. Said another way, the roof member is arranged above the female contact terminal 10 as seen in the mating direction 100 and blocks movement of the female contact terminal 10 in the mating direction 100. In FIGS. 5*a* and 5*b* also a ferrite element 31 is shown, which has a cavity and accommodates part of the female contact terminals 10. The cavity is shaped to match with the cross section of the terminals 10 to minimize any gaps between the inner walls of the cavity and the surface of the terminal arranged therein.

FIG. 6 shows a three-dimensional exploded view of the connector, respectively the connector housing 30. The housing 30 comprises a main body 37 including the cavities 32 for accommodating the terminals 10. The terminals 10 are connected to signal cables 35 and run through openings respectively cavities 31*c* in ferrite 31. Upon assembly, after the terminals 10, the ferrite 31 and the ends of cables 35 are arranged inside their respective space inside the main body 37, the roof 46 is attached to fix the terminals in place. After that, the connector can be closed by means of a cover 33.

FIG. 7*a* shows a top view of the connector in assembled condition, while the cover 33 is removed to allow a better view of the interior.

FIG. 7*b* shows a cut view of the connector of FIG. 7*a* along the lines A-A with the cover 33 attached. One can see how the male terminal 50 is arranged inside the connector housing 30 and being in contact with the engagement portion 16 of a female contact terminal 10. A part of the female terminal 10 is arranged inside cavity 31*c* of ferrite 31.

REFERENCE SIGNS

1 electrical connector
3 counter connector

10 female contact terminal
12 distal portion of female contact terminal
14 flexible spring arms
16 engagement portion
18 distal end portion of flexible spring arms
20 inner walls
22 cylinder
24 inclined surface
26 proximal portion of female contact terminal
28 gap
30 connector housing
31 ferrite
31*c* cavities of ferrite
32 terminal cavity
33 cover
34 first guide member
35 signal cables
36 second guide member
37 main body
38 inner cavity walls
40 locator member
42 counteracting locator member
44 spacer
46 roof member
50 male terminal
100 mating direction
200 female contact terminal extension direction

The invention claimed is:

1. An electrical connector, adapted to be mated with a corresponding counter connector in a mating direction, the electrical connector comprising:

at least one female contact terminal extending at least partially perpendicular to the mating direction in an extension direction; and a connector housing comprising at least one terminal cavity adapted to house the female contact terminal;

and wherein the female contact terminal comprises a distal portion with two flexible spring arms extending in the extension direction, an engagement portion is formed between the flexible spring arms, the engagement portion is adapted to engage a corresponding male terminal of the counter connector, the female contact terminal is cut from a piece of sheet metal, the two spring arms are unbent and arranged in a common plane perpendicular to the mating direction, and a spacer provided in a gap that extends between the flexible spring arms, wherein the spacer is provided at a distal end portion of the flexible spring arms, the spacer protrudes from an inner wall of the terminal cavity, and the spacer is adapted such that the female contact terminal is positioned in a predetermined mating position in the terminal cavity when tips of the flexible spring arms engage the spacer.

2. The electrical connector of claim 1, wherein the two springs arms are flat, each spring arm has an oblong rectangular cross section, and the spring arms are oriented in the cavity such that a longer perimeter of the rectangular cross section is in a plane perpendicular to the mating direction.

3. The electrical connector of claim 1, wherein the terminal cavity is shaped to essentially prevent movement of the female contact terminal housed therein in a direction parallel to the mating direction.

4. The electrical connector of claim 1, wherein the engagement portion is formed at a distal end portion of the flexible spring arms.

5. The electrical connector of claim 1, wherein inner walls of the engagement portion are arcuate such that they form a cylinder extending in the mating direction, and a radius of the arcuate inner walls is about twice a radius of the male terminal, perpendicular to the mating direction.

6. The electrical connector of claim 5, wherein the radius of the arcuate inner walls is in a range from 0.1 mm to 10 mm.

7. The electrical connector of claim 1, wherein the engagement portion of the flexible spring arms comprises inclined surfaces at a top and/or bottom side of the flexible spring arms along the mating direction to provide a funnel above and/or below the engagement portion adapted to guide the male terminal toward the engagement portion.

8. The electrical connector of claim 1, wherein the connector housing comprises a first guide member adapted to guide the male terminal toward the engagement portion parallel to the mating direction, and the first guide member tapers conically against the mating direction.

9. The electrical connector of claim 8, wherein the connector housing comprises a second guide member arranged adjacent above the first guide member, as seen against the mating direction, the second guide member is a square-shaped hole extending parallel to the mating direction, and the second guide member has a side length equal to a diameter of the male terminal.

10. An electrical connector, adapted to be mated with a corresponding counter connector in a mating direction, the electrical connector comprising:

at least one female contact terminal extending at least partially perpendicular to the mating direction in an extension direction; and a connector housing comprising at least one terminal cavity adapted to house the female contact terminal;

and wherein the female contact terminal comprises a distal portion with two flexible spring arms extending in the extension direction, an engagement portion is formed between the flexible spring arms, the engagement portion is adapted to engage a corresponding male terminal of the counter connector, the female contact terminal is cut from a piece of sheet metal, the two spring arms are unbent and arranged in a common plane perpendicular to the mating direction; and a roof member arranged above the female contact terminal as seen in the mating direction and configured to block movement of the female contact terminal in the mating direction, wherein the roof member and the connector housing together provide removably interlocking pins and holes to locate the roof member relative to the connector housing and capture the female contact terminal there between.

11. The electrical connector of claim 10, wherein the roof member is formed separate from the connector housing.

12. The electrical connector of claim 1, wherein inner walls of the terminal cavity comprise at least one locator member, and the female contact terminal comprises at least one corresponding counteracting locator member which is adapted to engage the locator member such that the female contact terminal is positioned in the terminal cavity at a predefined position when the locator member engages the corresponding counteracting locator member.

13. The electrical connector of claim 1, comprising at least one locator member and/or the spacer integrally formed with the connector housing.

14. The electrical connector of claim 1, wherein the electrical connector is a vehicle supplemental restraint system (SRS) connector.

15. The electrical connector of claim 1, comprising a ferrite element having a cavity to at least partially accommodate the female contact terminal, wherein the cavity is shaped to match with a cross section of the female contact terminal to minimize any gaps between inner walls of the cavity and a surface of the female contact terminal arranged in the cavity.

16. An electrical connector system, comprising the electrical connector according to one claim 1 and a corresponding counter connector.

17. The electrical connector system of claim 16, wherein the corresponding counter connector comprises a contact pin male terminal.

18. The electrical connector of claim 11, wherein the connector housing provides the holes and the roof member provides the pins.

19. The electrical connector of claim 18, wherein the male terminal is configured to extend through a bore in the roof member.

20. An electrical connector, adapted to be mated with a corresponding counter connector in a mating direction, the electrical connector comprising:

at least one female contact terminal extending at least partially perpendicular to the mating direction in an extension direction; and a connector housing comprising at least one terminal cavity adapted to house the female contact terminal;

and wherein the female contact terminal comprises a distal portion with two flexible spring arms extending in the extension direction, an engagement portion is formed between the flexible spring arms, the engagement portion is adapted to engage a corresponding male terminal of the counter connector, the female contact terminal is cut from a piece of sheet metal, the two spring arms are unbent and arranged in a common plane perpendicular to the mating direction, wherein at least one locator member comprises a protrusion extending from the inner walls of the terminal cavity and the counteracting locator member is a corresponding recess provided at a proximal portion of the female contact terminal extending through the female contact terminal, or the at counteracting locator member comprises a protrusion and the at least one locator member is a corresponding recess.

* * * * *